US005329998A

United States Patent [19]

King et al.

[11] Patent Number: 5,329,998

[45] Date of Patent: Jul. 19, 1994

[54] ONE TRIP TCP/GP SYSTEM WITH FLUID CONTAINMENT MEANS

[75] Inventors: Jon A. King, Jakarta Selatan; David L. Houdek, Balikpapan, both of Indonesia; Byron D. DePriest, Carenco, La.; Mark A. Phillips, Jakarta, Indonesia

[73] Assignee: Halliburton Company, Houston, Tex.

[21] Appl. No.: 995,382

[22] Filed: Dec. 23, 1992

[51] Int. Cl.[5] ..... E21B 43/00

[52] U.S. Cl. ..... 166/51; 166/278

[58] Field of Search ..... 166/51, 278, 297, 381, 166/386, 387

[56] References Cited

U.S. PATENT DOCUMENTS

| | | | |
|---|---|---|---|
| 4,253,522 | 3/1981 | Setterberg, Jr. | 166/278 |
| 4,540,051 | 9/1985 | Schmuck et al. | 166/278 |
| 4,541,484 | 9/1985 | Salerni et al. | 166/278 |
| 5,174,379 | 12/1992 | Whiteley et al. | 166/278 |

*Primary Examiner*—Thuy M. Bui

*Attorney, Agent, or Firm*—Tracy W. Druce; Dennis T. Griggs

[57] ABSTRACT

A combination perforating/gravel pack assembly includes a crossover circulation tool, a gravel pack screen, gravel pack accessories and a perforating gun which are interconnected by tubular flow conductors. External seals are located at longitudinally spaced locations along the upper end of the flow conductor string, above the gravel pack accessories and screens. External seals are also located at longitudinally spaced locations along the lower end of the flow conductor string, intermediate the screen and the perforating gun assembly. After crossover and reverse circulation are established, gravel slurry is pumped through an inner service string into the production annulus between the screen and the perforated casing. The slurry liquid is returned through a tell-tale screen upwardly through the washpipe and circulation tool, where it crosses over for return flow to the surface through a bypass annulus between the inner service string and the upper flow conductor seal assembly.

21 Claims, 7 Drawing Sheets

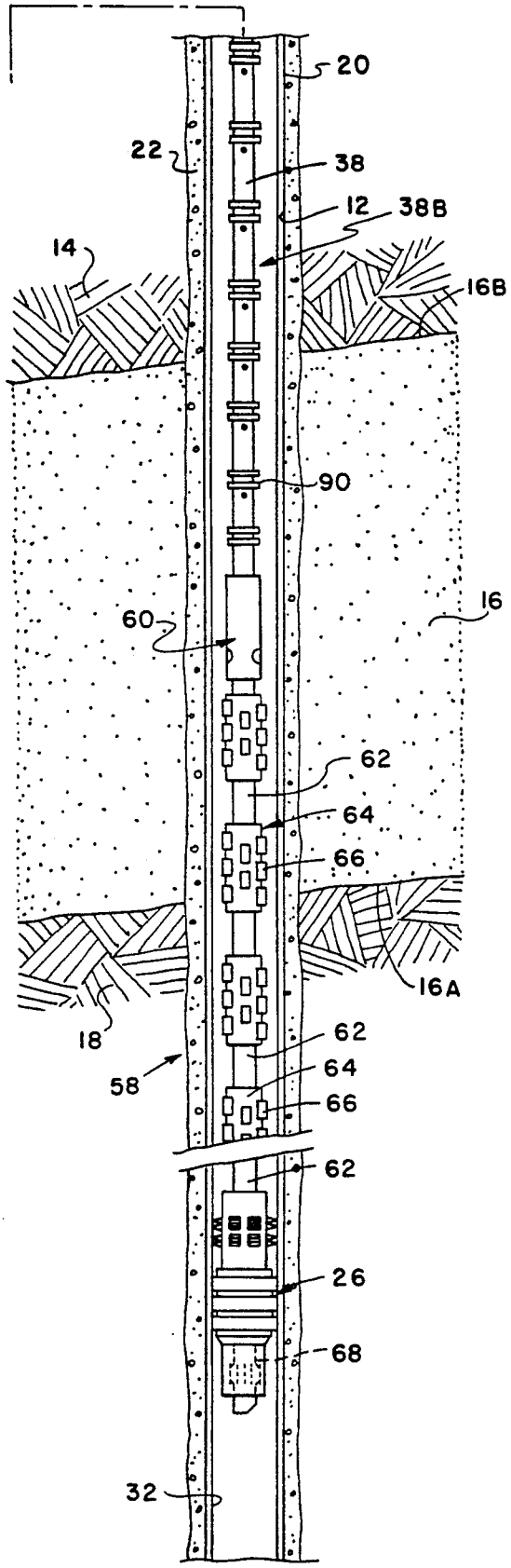
FIG. 3C (LOCATE BOTTOM)
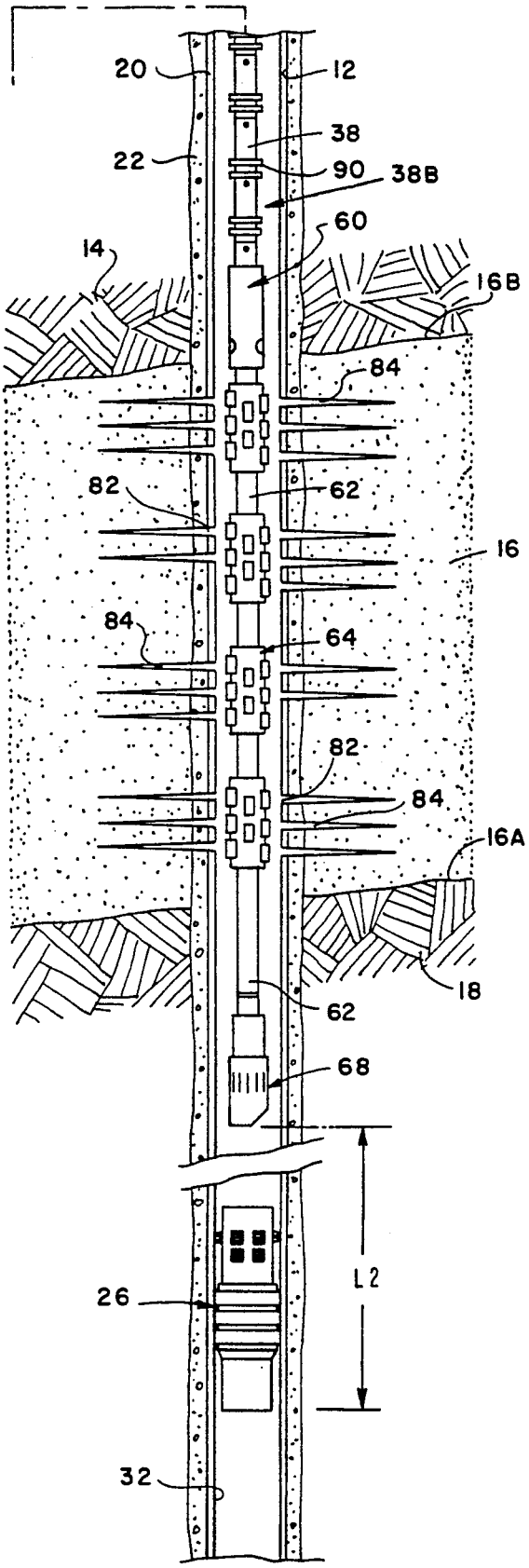
FIG. 3D (RETRACT & SHOOT)

ONE TRIP TCP/GP SYSTEM WITH FLUID CONTAINMENT MEANS

FIELD OF THE INVENTION

This invention relates generally to apparatus for completing wells, and in particular to systems for perforating and gravel packing wells.

1. Background of the Invention

In the course of completing an oil and/or gas well, it is common practice to run a string of protective casing into the well bore, and the annulus between the well casing and the well bore is sealed by cement. Thereafter, perforations are shot through the casing and cement into the formation to admit formation fluid flow into the well. A packer is customarily set above the producing zone to seal off the annulus in the zone where production fluids flow into the well. A production tubing string is coupled to the mandrel bore of the packer for conveying formation fluid to the surface, and one or more sand screens are suspended from the production packer for separating formation sand which may be swept into the flow path. The annulus around the screen may be packed with a relatively coarse sand or gravel which acts as a filter to reduce the amount of fine formation sand reaching the screen.

A common problem experienced during well completion and sand control operations is fluid loss after the well is perforated at the zone of interest. It is an inherent problem encountered worldwide, due to the high permeability of sand stone reservoirs which allow easy fluid flow into the formation matrix. Many wells which are candidates for sand control produce from marginal reservoirs and have insufficient bottom hole pressures to support a column of fluid in the well bore. Still other wells with high pressure zones require high density completion fluids in order to balance the reservoir pressure during the gravel pack operation. In any case, the positive pressure leads to completion fluids being lost to the reservoir.

Exposure to incompatible completion fluids may cause the following problems: (1) the formation may be damaged by swelling of clay and minerals within the formation; (2) formation damage may be caused by particle invasion into the formation; (3) formation damage may be caused by dissolution of matrix cementation, thus promoting migration of fines within the formation; (4) flow channel blockage by precipitates may be caused by ionic interactions between well servicing fluids and formation fluids; (5) interactions between well servicing fluids and formation fluids may cause emulsion blocks, water block, or changes in wetability of a producing sand; and (6) flow channel blockage may be caused by viscous fluids creating a barrier in the near well bore region.

The cost of completing a well is increased by the depth of the well and by the number of trips of completion apparatus that must be made into the well, for example for perforating and gravel packing. Moreover, because of the high value of the completion fluid, it is desirable to recover the completion fluid for use during subsequent operations.

2. Description of the Prior Art

Combination perforating and gravel packing apparatus are known which may be run into a well and, in a single trip, carry out perforation of the well casing and gravel packing the perforations and sand screen. A limitation on the use of such combined perforating and gravel packing apparatus is the requirement to kill the well with high density service fluids after the perforating guns have been fired for well control purposes. Some formations as discussed above experience severe damage when penetrated by incompatible service fluids, and in particular, high density, water-based service fluids. Another limitation is that it has not been possible to carry out an underbalanced shoot in such wells. Consequently, there is a continuing interest in providing a one trip perforate/gravel pack system which will prevent the escape of incompatible service fluids into the formation during perforating and gravel packing, and which will allow the casing perforation shoot to be performed in the underbalanced condition.

During some sand control operations, the standard procedure is to acidize the formation prior to gravel packing, thus increasing the near well bore permeability. Then it is recommended that the acid treatment be followed immediately with a gravel pack treatment until a sandout occurs. After gravel packing, the well bore is frequently in a lost circulation condition. This requires either keeping the hole full, resulting in loss of large volumes of service fluid to the formation, or unknowingly spotting an inappropriate fluid loss pill. Both options can result in formation damage and excessive completion cost.

After the gravel packing or other treatment is finished, completion fluids are introduced into the annulus between the work string and the well casing to displace the service fluids used during well treatment. Typically, the service fluids may include aqueous solutions of zinc bromide or calcium chloride, both of which may be harmful to the formation. The completion fluids are introduced into the annulus to displace the service fluids and to circulate out filter cake, drilling debris and the like.

OBJECTS OF INVENTION

The principle object of the present invention is to provide a one-trip perforate/gravel pack system for preventing the loss of incompatible service fluids into the surrounding formation during perforating and gravel packing operations.

A related object of the present invention is to provide a perforate/gravel pack system which the perforation shoot operation may be carried out while the well is in an underbalanced condition, without loss of incompatible service fluids to the surrounding formation.

SUMMARY OF THE INVENTION

According to the present invention, the seal bores of upper and lower packers are selectively sealed and opened by longitudinally spaced seal units mounted on a combination perforating/gravel pack tool. The combination perforating/gravel pack tool includes a crossover circulation tool, a gravel pack screen, gravel pack accessories and a perforating gun which are interconnected by a string of tubular flow conductors. A first set of longitudinally spaced seal units is located along the upper end of the flow conductor string, above the gravel pack accessories and the screen. A second set of longitudinally spaced seal units is located along the lower end of the flow conductor string, intermediate the screen and the perforating gun assembly. A separate bypass flow passage between the circulation tool and the surface is provided by an inner service flow conductor carried within the upper flow conductor string. A shiftable wash pipe is carried within the lower flow conductor string in flow communication with the circulation tool. The washpipe is movable from a return flow position for screen bypass flow downwardly through the work string and washpipe for discharge through a ported sub into the production annulus, and thereafter upwardly through the production annulus and packer bore and upper annulus to the surface, to a reversing position for receiving reverse circulation flow from the production annulus through a tell-tale screen for return to the surface through the washpipe and the annulus between the inner service conductor and the upper flow conductor string.

The upper annulus, which initially contains kill-weight, incompatible service fluid, is selectively opened by shifting the service string until the seal units are retracted out of the upper packer seal bore. A relatively lightweight, compatible completion fluid is then pumped through the inner service string and washpipe through the ported sub into the production annulus. The relatively heavy, incompatible service fluid in the production annulus is displaced into the upper service string/well casing annulus through the annulus between the upper service string and the upper packer bore. An underbalanced condition is imposed in the production annulus by replacing the heavy, incompatible service fluid with relatively lightweight, compatible completion fluid.

The work string is then moved to a sealing position within the upper packer bore in which the upper annulus is isolated and the perforating guns are positioned in alignment with the producing formation. Back pressure is maintained on the kill weight service fluid in the service string/well casing annulus above the upper packer for well control purposes. The kill weight service fluid is prevented from entering the production annulus by engagement of the seal units in the upper packer bore. After the guns have been fired, the perforation/gravel pack assembly is moved down, with the gravel pack screens moving into place across the new perforations. Since the upper annulus is isolated with respect to the production annulus by the long, upper seal unit assembly, the movement of the screens and perforating guns is accomplished without killing the well, and without the introduction of incompatible service fluids into the formation which might cause formation damage.

The assembly is prepared for gravel packing by running the perforating gun assembly through the seal bore of the bottom packer, and sealing the bottom packer bore with one or more longitudinally spaced seal units of the lower set. The circulation sub is opened to the crossover position, the washpipe is retracted to the reverse circulate position, and gravel slurry is pumped through the inner service string into the production annulus between the screen and the perforated casing. The slurry liquid is returned through the tell-tale screen, upwardly through the washpipe and circulation tool, where it crosses over for return to the surface through the bypass annulus between inner service string and the upper flow conductor seal assembly. After completion of the gravel pack, the circulation tool and washpipe are retrieved from the well. The longitudinally spaced seal units on the upper flow conductor string prevent loss of the kill weight service fluid from the upper annulus as the circulation tool and washpipe are pulled out of the well. An internal flapper valve closes the flow conductor bore as the washpipe is retrieved. The production annulus between the screen and well casing is isolated with respect to the well below the bottom packer by the longitudinally spaced seal units on the lower flow conductor string.

Operational features and advantages of the present invention will be understood by those skilled in the art upon reading the detailed description which follows with reference to the attached drawings.

BRIEF DESCRIPTION OF THE DRAWINGS

FIG. 3A, FIG. 3B, FIG. 3C and FIG. 3D are simplified views which illustrates the installation of the combination perforating/gravel packing tool of FIG. 2 in the well of FIG. 1, with the components being shown in the perforating position;

DETAILED DESCRIPTION OF THE PREFERRED EMBODIMENT

Figure 1:
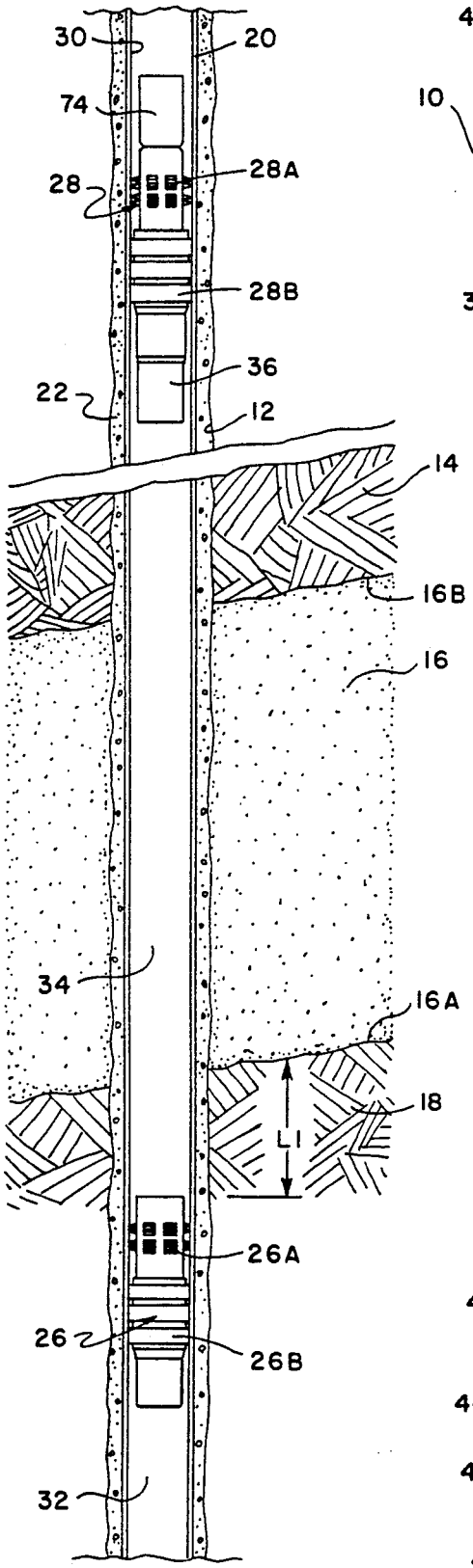
FIG. 1 is a simplified, sectional view which illustrates a producing formation which is intersected by a vertical well having a tubular casing and upper and lower retrievable seal bore packers.
Figure 2A:
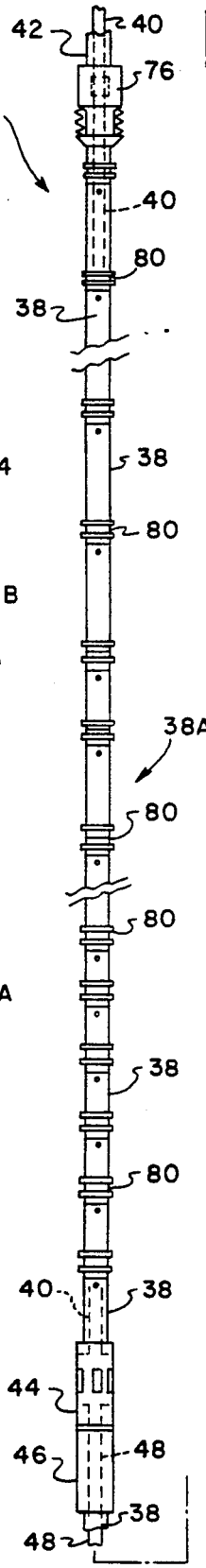
FIG. 2A, FIG. 2B and FIG. 2C are simplified, elevational views of the combination perforating/gravel packing tool of the present invention.
Figure 2B:
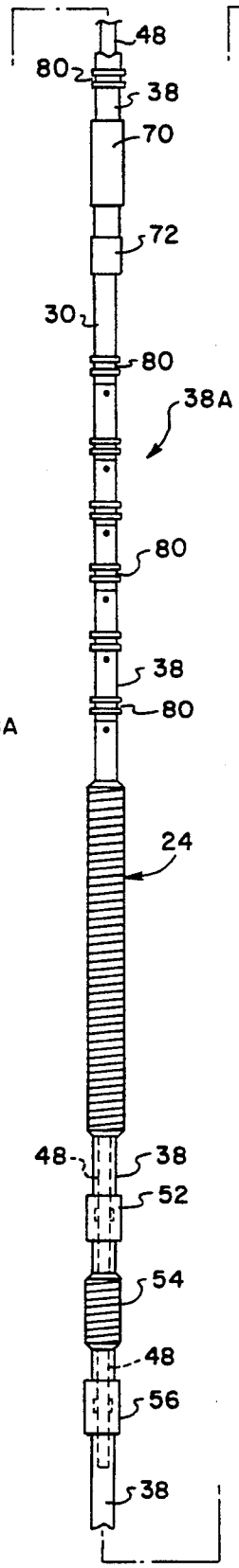
Figure 2C:
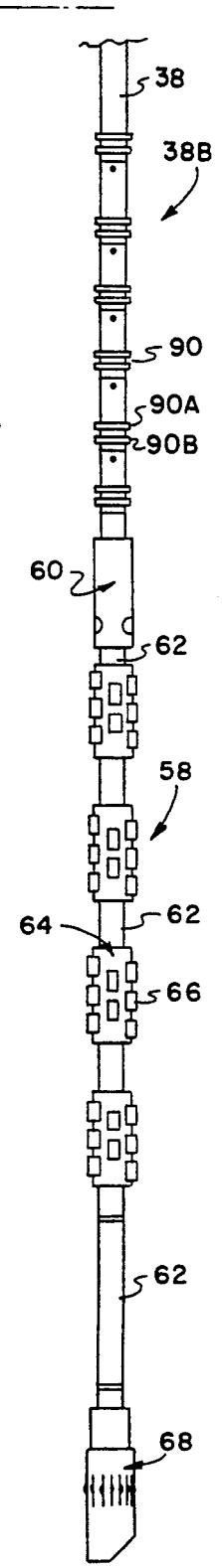

In the description that follows, like parts are marked throughout the specification and drawings with the same reference numerals respectively. The drawings are not necessarily to scale and the proportions of certain parts have been exaggerated to better illustrate details and features of the invention. As used herein, the designation "T" refers to a threaded union.

Referring now to FIGS. 1, 2A, 2B and 2C, a combination perforating/gravel pack tool 10 is provided for completing a production well 12. The production well 12 is drilled through multiple layers of overburden 14, traversing a hydrocarbon formation 16 and extending through multiple layers of underburden 18, typically of an impervious sandstone or other barren rock. For exemplary purposes, the hydrocarbon formation 16 may be considered to be a high permeability sandstone reservoir having a thickness ranging from about 100 feet to about 500 feet. The hydrocarbon formation 16 may be located in a normal pressure gradient formation at an average perforation depth of about 5,000 feet.

The well bore 12 is reinforced by a tubular casing string 20, and the annulus surrounding the well casing 20 is filled with a cement deposit 22, which prevents vertical flow of fluids from one formation to another. Consequently, the hydrocarbon producing formation 16 is isolated with respect to the production bore of the well casing, and it is therefore necessary to perforate the well casing 20 and cement deposit 22 to allow production fluids to enter the casing bore.

During production of the formation fluid, formation sand is also swept into the flow path. The formation sand is relatively fine sand that erodes production components in the flow path. One or more sand screens 24 are installed in the flow path between production tubing and the perforated well casing to separate sand fines from the formation fluid. A bottom sump packer 26 and an upper production packer 28 are set below and above the producing formation 16 to seal off the casing annulus in the zone where production fluids flow through the perforated well casing. In some wells, a packerless completion may be desired wherein the casing 20 is prefitted with seal bore flow conductors and landing receptacles such as a lock mandrel or a hydraulic hanger. In other wells, for example in highly deviated and horizontal completions, the well may be completed without a casing, and the production annulus being isolated by inflatable packers which engage the uncased facing of the well bore. In each installation, it is essential that a seal bore conductor be provided, either as the seal bore of the packer, a seal bore extension coupled to a packer or a seal bore flow conductor in a packerless completion. It is also customary to pack the annulus around the screen with a relatively coarse gravel which acts as a filter to reduce the amount of fine formation sand reaching the screen.

During the drilling operation, the well is controlled by circulating drilling mud through the drill string and up the annulus between the drill string and the well bore. After the casing 20 is run into the well bore and the outside annulus has been sealed by the cement deposit 22, kill weight service fluid is circulated through a work string into the casing well bore so that the production casing is thoroughly cleaned to remove mud cake and drilling debris from the casing walls. The service fluid is circulated until the returns are clean. At this time, the casing well bore 30 is completely filled with kill weight service fluid, and it may be necessary to maintain back pressure on the casing bore to control the well and to prevent a blow-out.

After the casing well bore 30 is clean and stabilized by the kill weight service fluid, the well is surveyed by a logging tool to determine the lower boundary 16A and upper boundary 16B of the hydrocarbon formation 16. After that determination has been made, the bottom packer 26 is run into the well at a depth L (approximately 20 feet) below the lower boundary 16A of the hydrocarbon producing formation. The bottom packer 26 is then set by an electric wire line and explosive charge for radially extending anchor slips 26A and radially expanding annular seal elements 26B. The annular seal elements 26B isolate the casing bore 32 below the bottom packer 26 with respect to the production casing bore 34 which traverses the hydrocarbon producing formation 16.

The top packer 28 is set by electric wire line at a sufficient distance above the upper boundary 16B of the hydrocarbon formation 16 to allow the components of the perforating/gravel pack tool 10 to be suspended within the production bore 34 below the top packer 28 when the perforating guns are positioned in shoot alignment with the well casing section which traverses the hydrocarbon formation 16. The upper packer 28 is equipped with radially extendable anchor slips 28A and radially expandable seal elements 28B which securely set and seal the packer against the casing bore 30. The expandable seal elements 28B isolate the production casing bore 34 with respect to the upper casing bore 30.

After the top packer 28 has been securely set and sealed, the well casing 20 surrounding the production bore 34 is ready for perforation. At this time, the bore of the well casing 20 is still filled with kill weight service fluid, for example, an aqueous solution of zinc bromide, calcium chloride or sodium chloride, which could have a harmful effect if introduced into the hydrocarbon producing formation 16. Consequently, the purpose of the combination perforating/gravel pack tool 10 is to provide for perforation of the well casing across the tubular well casing 20 which traverses the hydrocarbon producing formation 16 while preventing the escape or introduction of harmful/incompatible service fluid into the producing formation, and at the same time maintaining the upper bore 30 of the well casing and the work string pressurized with kill weight service fluid for well control purposes.

The combination perforating/gravel pack tool 10 also makes it possible for the shoot to be performed while the production annulus 34 is maintained in an underbalanced hydrostatic condition, without releasing or otherwise introducing incompatible kill weight service fluid into the hydrocarbon producing formation after the well casing has been perforated. The combination perforating/gravel pack tool 10 is also equipped with components which permit a gravel packing operation to be carried out while maintaining the upper casing bore 30 pressurized with kill weight service fluid for well control purposes, without releasing or otherwise introducing the kill weight service fluid into the producing formation during the gravel packing operation.

In one embodiment, the lower packer 26 and the upper packer 28 each have a seal bore I.D., for example 6.00 inch. A seal bore extension sub 36, for example twenty-five foot length, is suspended from the packer 28 with its seal bore connected in smooth bore alignment with the production mandrel bore of the packer 28. Each packer is retrievable, and has anchor slips and seal elements adapted for set/seal engagement against the well casing I.D., which is 9⅝ inch in the exemplary embodiment.

The combination perforating/gravel pack tool 10 is an assembly of various perforating, gravel packing and production components which are interconnected by a string of tubular flow conductors 38. An inner service flow conductor 40 is run from the surface inside of a tubular work string 42. The inner service flow conductor 40 is also extended in concentric relation inside the tubular flow conductor string 38, and is coupled to the production bore of a circulation tool 44. A seal bore extension sub 46 is suspended from the circulation tool 44, with its seal bore coupled in flow communication with the production bore of the circulation tool 44. The screen 24 is coupled to the seal bore extension sub 46 by the tubular flow conductor string 38. A washpipe 48 is suspended from the production mandrel 50 of the circulation tool 44. The lower end of the washpipe 48 is extended through the tubular flow conductor string 38, through the production mandrel of the screen 24, through a seal bore sub 52, through the production mandrel bore of a tell-tale screen 54, and through a second seal bore sub 56.

A perforating gun assembly 58 is coupled to the lower seal bore extension sub 56 by the tubular flow conductor string 38. The gun assembly 58 includes a ported coupling sub 60, a releasing sub (not shown) and pup joints 62. In the exemplary embodiment, the perforating gun assembly includes four gun mandrels 64 which include an array of shaped, charged jet-type perforating guns 66. Each perforating gun is equipped with an impact (percussion) detonator. Detonation is obtained by dropping a firing bar through the inner service flow conductor 40 and washpipe 48 downwardly through the lower seal assembly 38B to the detonator head.

A collet latch assembly 68 is coupled to the lower end of the gun assembly 58 by a pup joint 62. The collet latch 68 is used for confirming the location of the perforating/gravel pack tool 10 upon latching engagement with the bottom packer 26. Since the depth location of the bottom packer 26 is known, and the longitudinal position of the screen 24 and perforating guns 64 relative to the locator head 76 are also known, the screen and guns may be accurately positioned with respect to the hydrocarbon producing formation 16 so that perforating and gravel packing can be carried out effectively.

Figure 9:
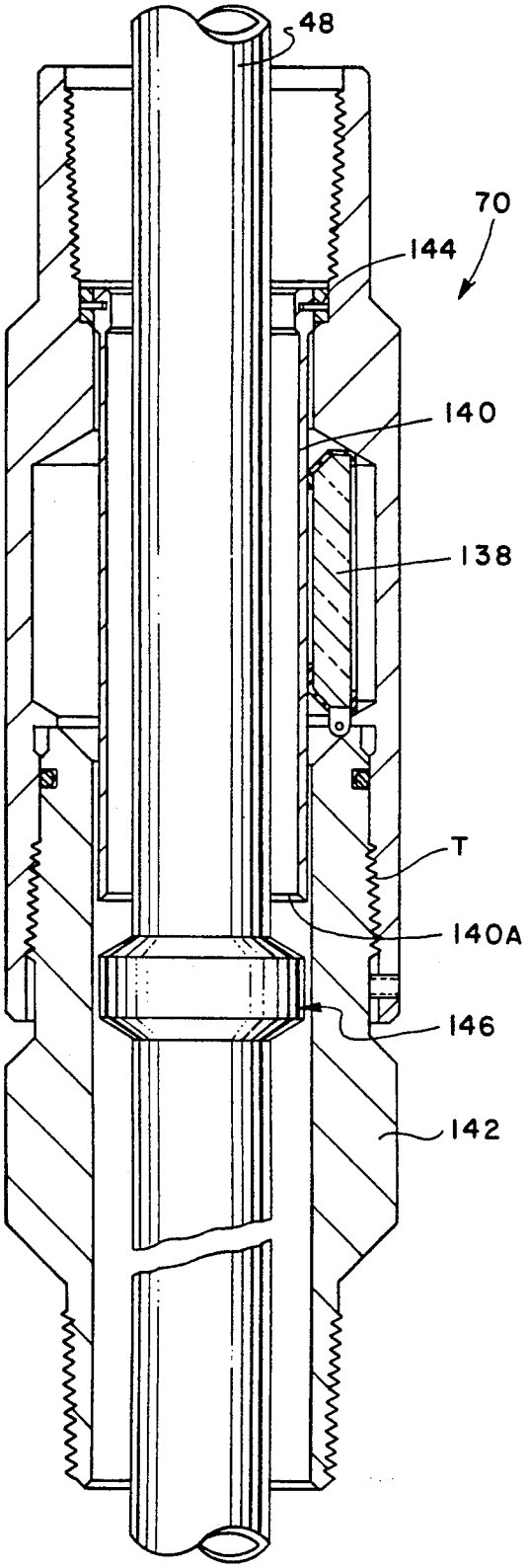
FIG. 9 is a sectional view of a flapper valve assembly, shown in the open position; and, FIG. 10 is a view similar to FIG. 9, with washpipe withdrawn and flapper valve in the closed position.
Figure 10:
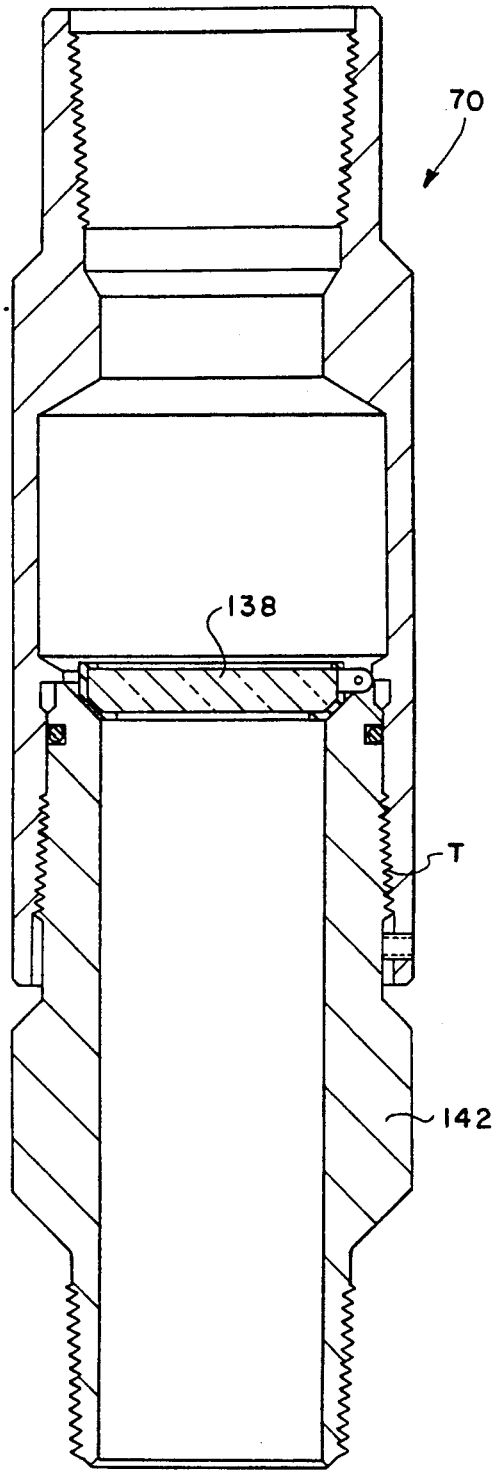

Suspended below the circulation tool 44 and seal bore extension 46 is a flapper valve 70 and a safety release sub 72. Construction details of the flapper valve 70 are shown in FIG. 9 and FIG. 10. The flapper valve 70 is preferably constructed as disclosed in U.S. Pat. No. 4,813,481 assigned to Otis Engineering Corporation, which is hereby incorporated by reference. The purpose of the flapper valve 70 and the safety release sub 72 will be discussed in detail hereinafter.

The perforating/gravel pack tool assembly 10 includes a ratch latch assembly for producing releasable, latching engagement with the upper packer, and longitudinally spaced seal units for producing slidable, sealing engagement between the tubular flow conductor string 38 and the seal bores of the lower packer 26 and the upper packer 28.

Releasable, mechanical latching engagement with the upper packer 28 is provided by a ratch latch locator receptacle 74 which is secured to the entry end of the upper packer production mandrel 28M. The ratch latch locator receptacle 74 is releasably engageable by a ratch latch head 76 which is secured to the upper end of the tubular flow conductor string 38. The ratch latch head 76 is coupled to the work string 42, which is suspended from a rotary work platform at the surface. The overall length of the perforating/gravel pack tool 10, from the ratch latch head to the collet latch 68 is known, and the longitudinal spacing of each component relative to the ratch latch head 76 is also known. By this arrangement, the perforating guns may be accurately positioned in shoot alignment with the hydrocarbon producing formation 16 during a perforating operation, and the production screen 24 may be accurately positioned in alignment with the perforating casing during gravel packing and production.

Figure 8:
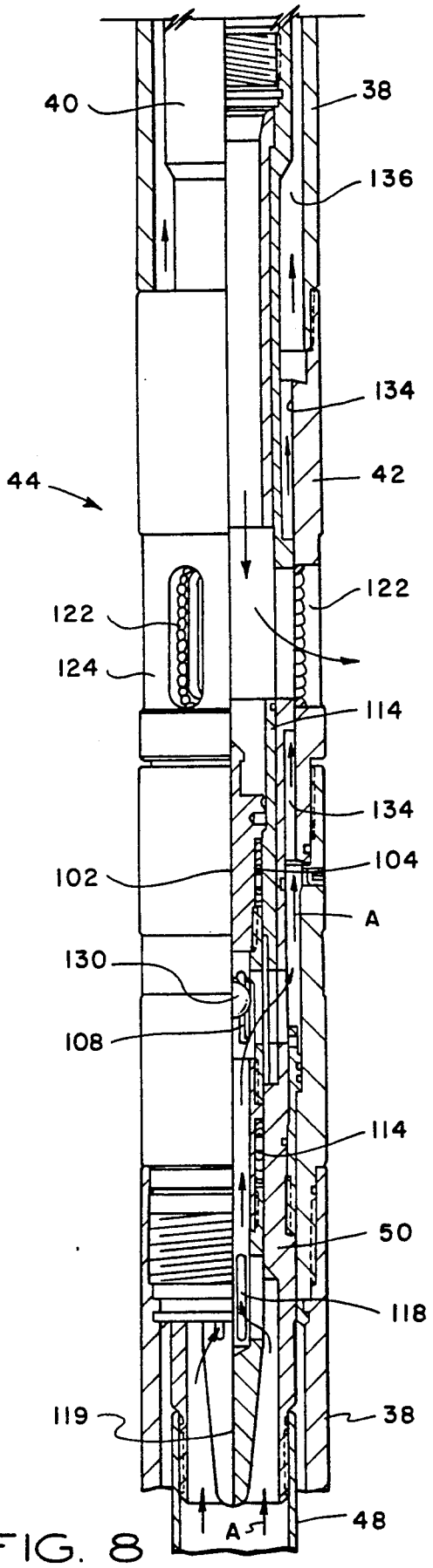
FIG. 8 is a view similar to FIG. 6, showing the dart of FIG. 7 and isolation sleeve of FIG. 6 in the gravel pack position.

The inner flow conductor 40 and the washpipe 48 are secured in flow communication with bore of the production mandrel 50 of the circulation tool 44 as shown in FIG. 8.

Figure 3A:
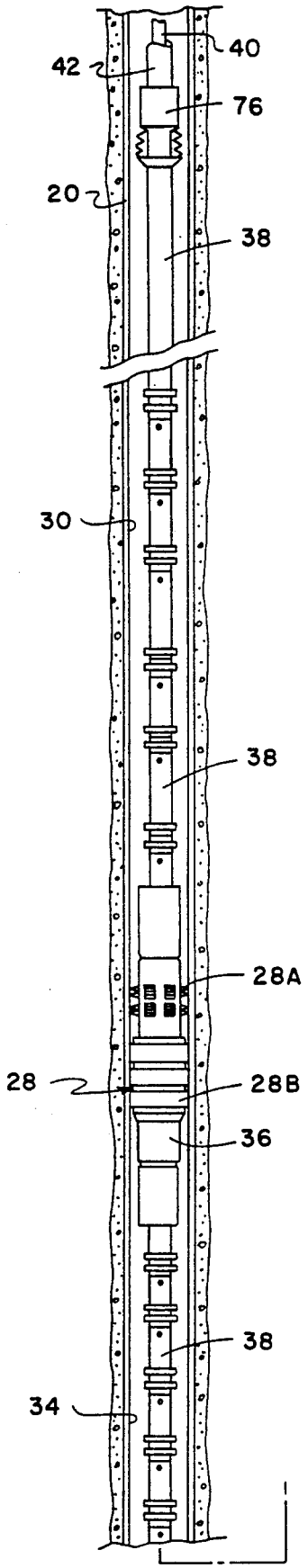
Figure 3B:
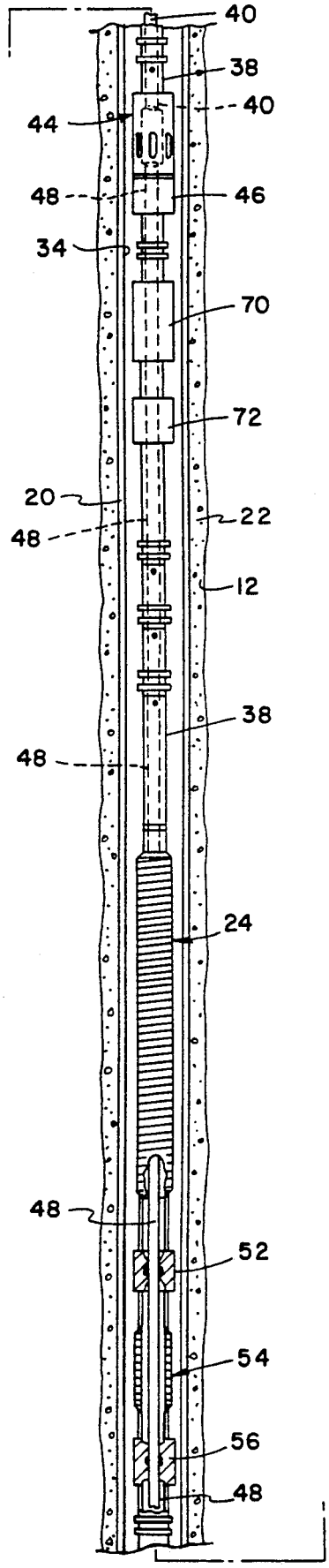

The circulation tool 44, production screen 24, gravel pack accessories and the perforating gun assembly 58 are interconnected by upper and lower tubular flow conductors 38 to form a flow conductor service string having an upper flow conductor string section 38A extending between the screen 24 and the ratch latch head 76 and having a lower flow conductor string section 38B extending between the perforating gun assembly 58 and the production screen 24. The washpipe 48 is carried within the lower flow conductor string section 38B and the inner service string 40 is carried within the upper flow conductor string 38A. Isolation of the upper annulus 30 is provided by a first set of seal units 80 which are located at longitudinally spaced locations along the upper tubular flow conductor string 38A above the gravel pack accessories. One or more seal units 80 of the upper seal assembly seal the mandrel bore of the top packer 28 when the perforating guns 64 are in the firing position (FIG. 3D), thus isolating the intermediate production annulus 34 and perforations with respect to the upper annulus 30.

An underbalanced condition is established by first shifting the upper seal string 38A until the mandrel bore of the upper packer 28 is opened, thereby providing a return flow annulus through the upper packer 28 to the upper casing workstring annulus 30. Then, compatible, lightweight completion fluid, for example diesel, is pumped through the upper service string 40 and washpipe 48 through the ported sub 60 into the intermediate production annulus 34. The lightweight completion fluid displaces the incompatible service fluid upwardly through the return flow annulus between the flow conductor 38 and upper packer mandrel bore, and thereafter through the casing/workstring annulus 30 to the surface for recovery. After all of the heavy, incompatible service fluid in the intermediate production annulus 34 has been displaced by the lightweight completion fluid, the perforating gun assembly 58 is repositioned and the upper packer mandrel bore is resealed by the seal elements 80 of the upper seal string 38A. The perforating guns are then fired while an underbalanced condition is being maintained by the lightweight, compatible completion fluid in the production annulus 34 and in the service conductor string 40.

An underbalanced pressure condition within the well bore is desirable so that a high surge pressure differential will be exerted by the surrounding formation and will clear the perforation tunnels. Upon detonation, the shaped charges 66 within the gun 64 explode and produce high temperature, high pressure plasma jets which penetrate the well casing 20 and the surrounding formation 16. The jet streams punch holes 82 through the well casing 20 and produce a slender fracture tunnel 84 radially through the surrounding hydrocarbon formation 16. As the jet plasma stream penetrates the surrounding formation, it sometimes contacts the formation and may produce a compacted cone which blocks the newly formed casing perforation 82. When the perforating operation is conducted in an overbalanced well bore condition, formation fluids, mud and debris from the well bore will be forced outwardly into the formation perforation tunnel 84 and may plug the casing perforation.

Experience has shown that during an overbalanced shoot, as much as eighty percent of the well casing perforations may become plugged by grains of sand, mud, cement cake, pipe dope, and the like which are often abundant in the well at that stage of completion. Accordingly, it is desirable to perforate the well casing in an underbalanced pressure condition relative to the surrounding formation 16. Preferably, the compatible, lightweight completion fluid (diesel) should be maintained at a pressure level sufficient to produce a pressure differential of from about 10 psi to about 700 psi below the pressure of the surrounding formation. With such a high pressure differential, the pressure surge from the surrounding formation will break up any compacted materials and sweep them back into the well bore where they will flow to the surface. As the compacted fragments are swept away, the casing perforations 82 are cleared for maximum inflow. Moreover, mud and debris will also be swept away from the perforation openings and flow to the surface.

Figure 4A:
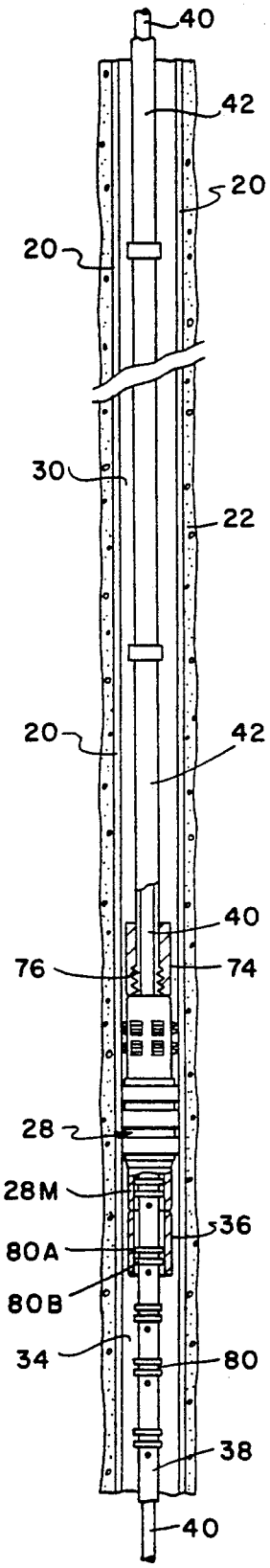
FIG. 4A, FIG. 4B and FIG. 4C illustrate the relative position of the components in the gravel packing position.
Figure 4B:
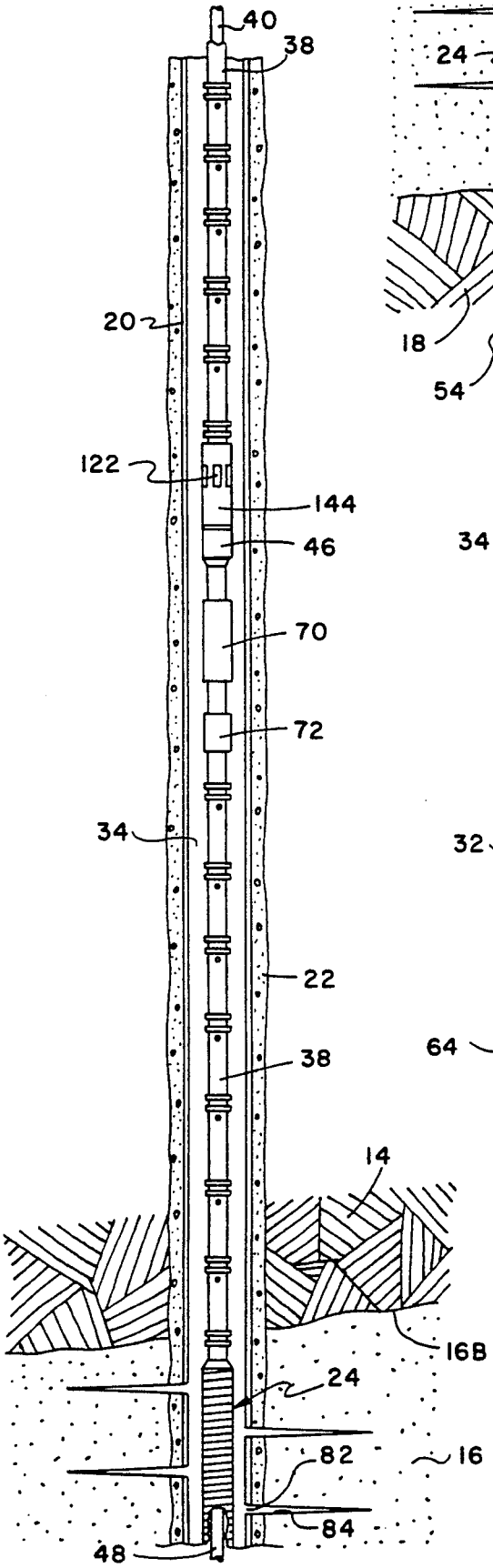
Figure 4C:
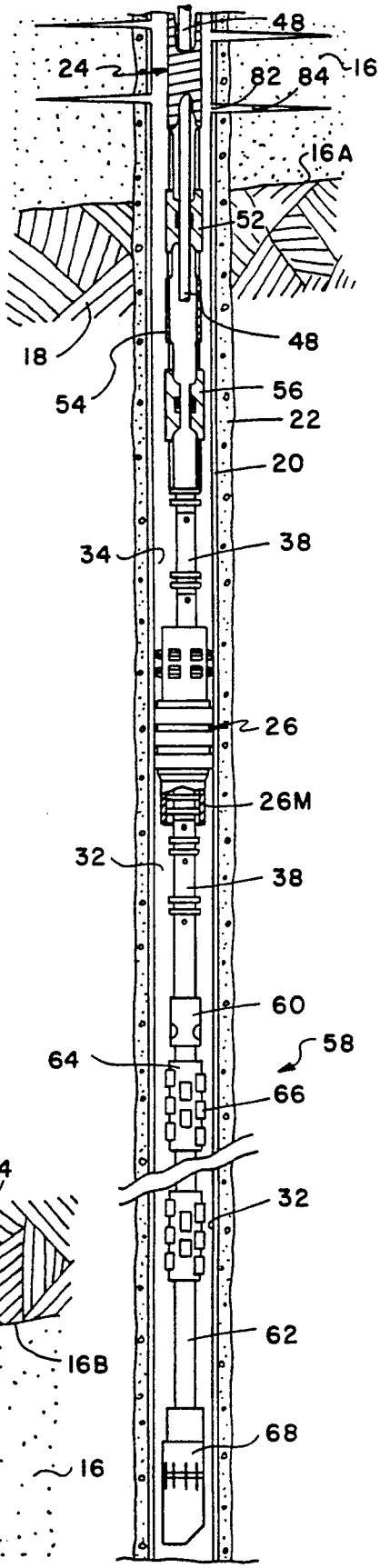

After the guns have been fired, the perforating/gravel pack assembly 10 is moved down, with the production screen 24 moving into place across the casing perforations 82 (FIG. 4C). Since the perforations are isolated from the annulus by the top packer 28 and the long upper seal assembly 38A, this movement of the screen and perforating gun assembly 58 is accomplished without killing the well, thereby avoiding the introduction of incompatible service fluids into the formation which might cause formation damage.

After the perforations 82 have been formed, the perforating/gravel pack assembly 10 is moved downwardly with the perforating gun assembly 58 being run through the bottom packer 26. The mandrel bore of the bottom packer is sealed by one or more seal units 90 in the lower set 38B of seals between the perforating gun and the tell-tale screen assembly. Downward movement of the perforating/gravel pack assembly 10 is restricted by engagement of the ratch latch head 76 against the locator receptacle 74 (FIG. 4A), and the gravel pack screens 24 are accurately positioned into place across the new perforations 82 (FIGS. 4B, 4C). The perforations 82 are isolated from kill weight service fluid in the upper annulus 30 by one or more of the upper seal units 80 in the mandrel bore of the top packer 28, and are isolated with respect to the lower annulus 32 below the bottom packer 26 by one or more of the lower seal units 90 which are sealed against the mandrel bore of the bottom packer 26.

Figure 5:
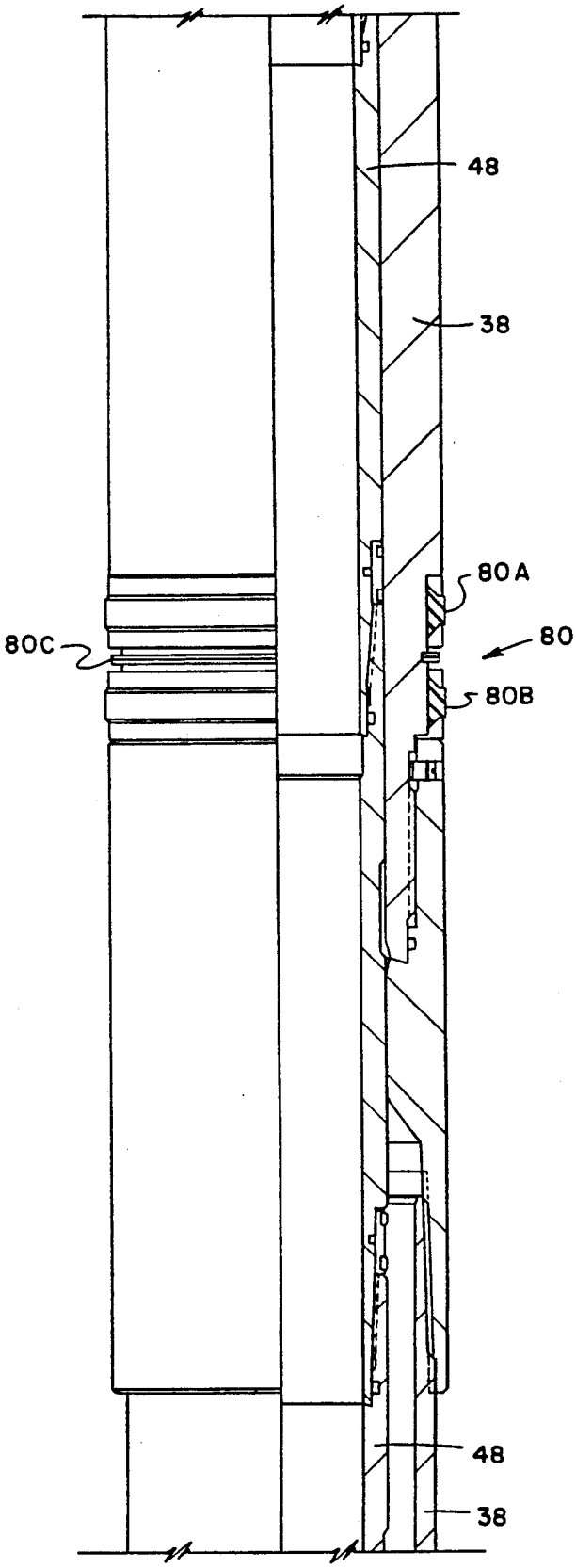
FIG. 5 is an elevational view, partially in section, of a tubular flow conduit having externally mounted seal elements adapted for sealing engagement within a packer seal bore.

Referring to FIG. 5, each seal unit 80 includes a stack of annular seal elements 80A, 80B which are separated by a spiral retainer ring 80C. As shown in FIG. 4A, the seal elements are dimensioned for slidable, sealing engagement with the packer mandrel bore 28M, and with the bore of the seal bore extension sub 36. The seal units 90 of the lower flow conductor 38B have seal elements 90A, 90B and 90C of identical construction. After flowing the well back is completed, and the guns have been lowered through the bottom packer until the ratch latch locator 76 has been latched in the locator receptacle 74, the seal units 90 above the perforating guns are packing off in the mandrel bore of the lower packer 26. This allows the lower packer 26 to perform the function of a sump packer for the gravel pack operation and subsequent production.

A tension load of about 15,000 pounds above the pickup weight is induced in the service string 42 to verify a positive latched condition at the locator receptacle 74. Since the longitudinal positions of the perforating guns 58, lower seal units 38B and screen 24 are precisely known with respect to the location of the ratch latch head, the positive latched condition also confirms that the lower seal units 38B are packed off within the mandrel bore of the lower packer 26, that the perforating gun assembly 58 is in the lower casing bore 32 below the bottom packer 26, and that the production screens 24 are in substantial flow alignment with the perforated well casing section. After this has been established, the upper annulus 30 is pressurized hydraulically to release the locator head 76, to permit longitudinal movement of the upper seal assembly 38A. The assembly is then further prepared for gravel packing by dropping a dart 100 into the mandrel bore 50A of the circulation tool 44.

Figure 6:
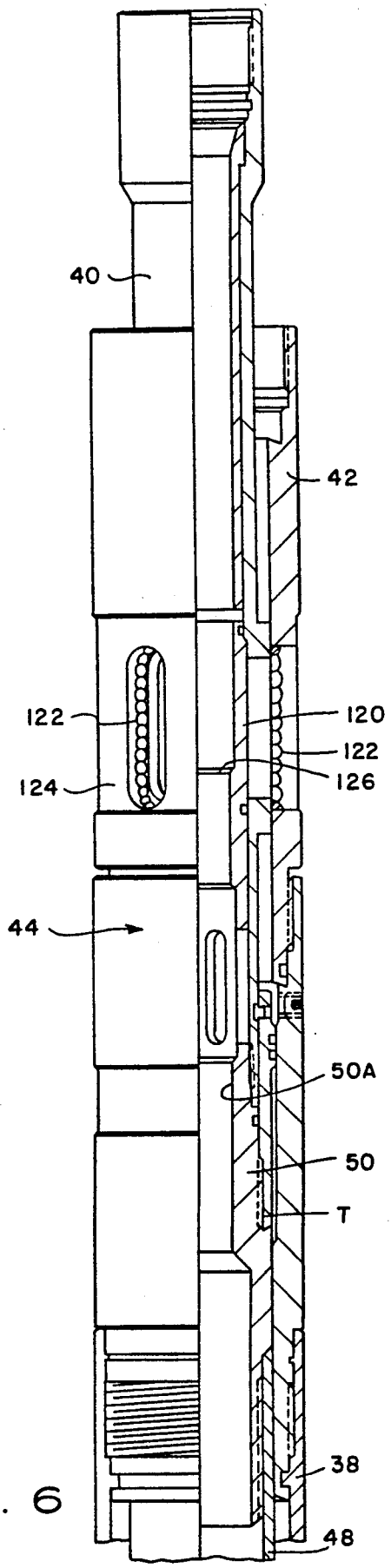
FIG. 6 is an elevational view, partially in section, of an isolation sleeve in the closed position.
Figure 7:
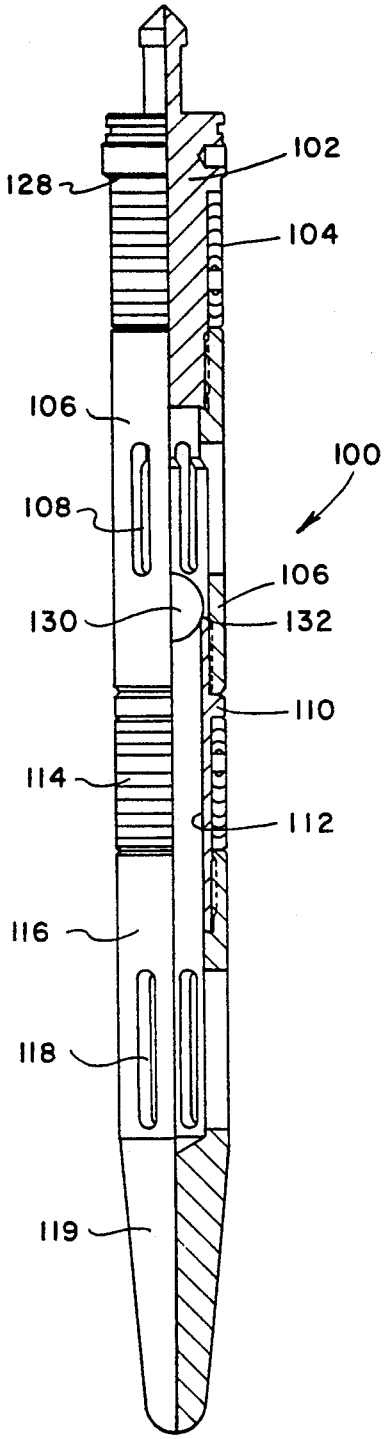
FIG. 7 is an elevational view, partially in section, of a dart circulation tool.

Referring to FIG. 6, FIG. 7 and FIG. 8, the dart 100 has a head 102 on which a first annular seal assembly 104 is mounted. Connected to the head 102 is a tubular flow conductor 106 which is radially intersected by elongated flow ports 108. Secured to the lower end of the flow conductor 106 is a tubular mandrel 110 having a longitudinal bore 112 connected in flow communication with the bore of the flow conductor 106. A second annular seal assembly 114 is mounted about the tubular mandrel 110. A second tubular mandrel 116 is secured to the lower end of the first tubular mandrel 110, and is radially intersected by flow ports 118. The dart 100 is terminated by a tapered nose 119.

Referring to FIG. 8, the dart 100 is dropped down the bore of the inner service flow conductor 40 and freefalls through the washpipe 48 until it enters the mandrel bore 50A of the circulation tool 44 and its movement is arrested by engagement of the annular seals 104, 114. At that point, the closure sleeve 120 of the circulation tool 44 is in the closed position, sealing the production bore 50A with respect to radial side ports 122 which intersect the tubular side wall 124 of the circulation tool 44. The closure sleeve 120 has an internal shoulder 126 which provides a no-go stop for engaging a mating shoulder 128 on the head 102 of the dart 100. The dart 100 has a check valve ball 130 engaged against an annular seating surface 132 formed on the tubular mandrel 110.

The closure sleeve 114 is shifted to the open port position as shown in FIG. 8 by applying hydraulic pressure through the inner service flow conductor 40, which drives the no-go shoulder 128 of the dart 100 into engagement with the no-go shoulder 126 which arrests further movement of the dart 100.

After the closure sleeve 120 has been opened, any formation fluids produced may be reversed out of the production annulus 34 and out of the work string flow conductors by displacing such formation fluids with a lightweight, compatible completion fluid such as diesel. Referring to FIG. 4B and FIG. 4C, the inner service flow conductor 40 and the washpipe 48 are retracted upwardly by about 36 inches relative to the upper flow conductor string 38A, which positions the lower end of the washpipe 48 out of sealing engagement with the lower seal bore sub, and opens flow communication through the tell-tale screen 54. The circulation tool 44 is thus retracted from its run-in position in which the tailpipe is sealed within the polish bore of the lower seal bore sub 56 to a circulating position in which the lower open end of the tailpipe 48 is positioned within the tell-tale screen 54 and is sealed against the polish bore of the upper seal bore extension sub 52 (FIG. 4C).

In the circulating position, gravel is pumped through the work string and through the bore of the circulation tool 44 where it is diverted by the check valve ball 130 and discharged through the radial side ports 122 into the production annulus between the production screen 24 and the perforated casing 20. The gravel pack is deposited as gravel accumulates in the annulus around the lower tell-tale screen, with the gel or other carrier liquid being circulated upwardly through the washpipe 48 and through the bypass annulus 136 between the inner service conductor 40 and the outer flow conductor 38, where it is returned to the surface.

With the upper packer mandrel bore and the seal bore extension sub 36 being sealed by one or more seal units 80, compatible completion fluid (for example diesel) is pumped down the inner service flow conductor 40 where it is discharged through the radial flow ports 122 into the production annulus 34, and is reverse flow circulated through the tell-tale screen 54 and upwardly through the washpipe 48.

Referring to FIG. 8, the return circulation flow is indicated by the arrows A. The reverse circulation flow enters the lower flow ports 118 in the dart, are conducted through the flow passage bore 112, and are discharged through the radial flow ports 108. The ball 130 is lifted off its seat 132 by the force exerted by the reverse circulation flow. The reverse circulation flow continues upwardly through annular flow passages 134 which are in communication with the annulus 136 between the inner service flow conductor 40 and the work string 42. Two work string volumes of compatible completion fluid are circulated through the production annulus 34 to provide good cleanout of the production annulus and work string.

After the produced formation fluids have been displaced by the compatible completion fluid, the gravel packing operation is performed. At this point, the service string 42 is slacked off and the locator head 76 is latched into the locator receptacle 74 (see FIG. 4A, FIG. 4B and FIG. 4C). Gravel slurry is then pumped down the inner service flow conductor string 40 and is discharged through the side ports 122 of the circulation tool 44 into the production annulus 34. Preferably, the gravel slurry is a low density pack with diesel as the carrier fluid. The well will be allowed to circulate if possible. The check valve ball 130 in the drop dart 100 will prevent the fluid in the bypass annulus from escaping into the formation. The diesel carrier is circulated through the tell-tale screen 54 and is returned through the washpipe 48 and through the bypass annulus 136 upwardly to the surface for recovery.

After the gravel pack has been completed, the circulation tool is raised to the reversing position to permit excess slurry to be reversed out of the production annulus 32. After reversing out the excess slurry, the circulation tool is raised until the bottom of the washpipe 48 is retracted well above the expendable flapper closure plate 138.

The flapper closure plate 138 is held in the valve open position during run-in, perforating and gravel packing by a prop sleeve 140. The prop sleeve 140 has a thin cylindrical sidewall which is concentrically received in sliding engagement against the flow passage bore of the flapper valve housing 142. Preferably, the prop sleeve 140 is secured by shear pins 144 which anchor the prop sleeve onto a collar ring 146 which is fitted inside the valve housing sub. According to this arrangement, the flapper valve closure plate 138 is held open during run-in, perforating and gravel packing to permit unrestricted passage of the washpipe and other downhole tools. The flapper valve closure plate 138 is subsequently released by applying a shearing force against the lower annular face 140A of the prop sleeve 140. According to the preferred embodiment, the washpipe 48 carries a collar 146 which engages the annular face 140A and carries the prop sleeve 140 to the surface as the work string 42, circulation mandrel 50, inner service flow conductor 40, dart 100, and washpipe 48 are retrieved to the surface.

As the washpipe 48 is retrieved, the flapper valve closure plate 138 closes (FIG. 10), thus preventing loss of the service fluid. Additionally, the service fluid is contained by one or more of the seal units 80 in the upper set 38A which are sealed against the mandrel bore of the upper packer 28 at all times. The flapper valve 70 has a frangible, ceramic closure element 138 which closes as the bottom of the washpipe 48 is retrieved. The flapper valve 70 maintains isolation of the perforations while the gravel pack service tool 44 and washpipe 48 are retrieved and while production tubing is run into the well.

After the production tree has been mounted on the well head, a 3.88 inch production seal unit is run on production tubing. The production seal unit is landed in the ratch latch locator 74 and a pressure test is run on the annulus. A shifting tool is then run down the production tubing to close the circulation tool flow ports 122. After the kill weight service fluid has been replaced by compatible completion fluid, the ceramic flapper is fractured (for example, with a drop bar) to permit production operations to begin.

Although the invention has been described with reference to a vertical well completion and with reference to particular preferred embodiments, the foregoing description is not intended to be construed in a limiting sense. The perforating/gravel packing apparatus of the present invention may be used to good advantage in alternative applications in which a well is completed with a packer, for example in gas wells, environmental wells, including monitoring wells, recovery wells and deviated well completions. It is therefore contemplated that the appended claims will cover any such applications which incorporate the combination perforate/-gravel pack assembly of the present invention.

What is claimed is:

1. Apparatus for completing a well having a well bore intersecting an earth formation, including first and second seal bore conductors each having a seal bore mandrel installed at first and second longitudinally spaced locations, respectively, within the well, said well completion apparatus comprising, in combination:

a tubular flow conductor adapted for suspension from a well head assembly and for longitudinal movement through the seal bore mandrels;

a well completion tool coupled to said tubular flow conductor for performing a well completion operation;

annular seals externally mounted on said tubular flow conductor at longitudinally spaced locations thereon, said annular seals being adapted for slidable, sealing engagement against the seal bore mandrels of said seal bore conductors; and said annular seals being disposed in first and second groups, said first and second groups of annular seals being longitudinally separated with respect to each other by a distance sufficient to permit sealing engagement of one or more annular seals of the first group against the seal bore mandrel of the first seal bore conductor simultaneously with sealing engagement of one or more annular seals of the second group against the seal bore mandrel of the second seal bore conductor, respectively.

2. The well completion apparatus as defined in claim 1, including:

a well screen assembly having a production mandrel coupled in flow communication with said tubular flow conductor, said well screen assembly being disposed intermediate to the first and second groups of annular seals;

a flow circulation tool having a circulation mandrel coupled in flow communication with said tubular flow conductor, said circulation tool including a movable closure member for selectively opening and closing a bypass flow passage through said circulation mandrel into the annulus between said tubular flow conductor and the well bore; and, a washpipe extending through the bore of said tubular flow conductor, said washpipe having a first end portion coupled in flow communication with the circulation tool, and having a second end portion extending through the production mandrel of said screen.

3. The well completion apparatus as defined in claim 1, including:

a flow circulation tool having a circulation mandrel coupled in flow communication with said tubular flow conductor, said circulation tool including a movable closure member for selectively opening and closing a bypass flow passage through said circulation mandrel into the annulus between said tubular flow conductor and the well bore;

a first seal bore sub suspended from said well screen;

a tell-tale screen suspended from said first seal bore sub;

a second seal bore sub suspended from said tell-tale screen; and, a washpipe coupled in flow communication with the circulation mandrel of said flow circulation control tool, said washpipe projecting through the first seal bore sub, the tell-tale screen and the second seal bore sub, said washpipe being movable from a first position in which it is disposed in sealing engagement against the first seal bore sub and the second seal bore sub, to a second position in which its open end is positioned in flow communication with the bore of the tell-tale screen.

4. The well completion apparatus as defined in claim 3, including:

a flapper valve assembly coupled in flow communication with said tubular flow conductor intermediate said well completion tool and said flow circulation tool.

5. The well completion apparatus as defined in claim 1, including:

a flow circulation tool having a circulation mandrel coupled in flow communication with said tubular flow conductor, said circulation tool including a movable closure member for selectively opening and closing a bypass flow passage through said circulation mandrel into the annulus between said tubular flow conductor and the well bore;

an inner service flow conductor extending in radially spaced relation through the bore of said tubular flow conductor thereby defining a bypass return flow annulus, said inner flow conductor being coupled in flow communication with the circulation mandrel of said circulation tool.

6. The well completion apparatus as defined in claim 1, including:

apparatus coupled to said tubular flow conductor for selectively positioning said well completion tool at multiple operating locations relative to said seal bore conductor.

7. The well completion apparatus as defined in claim 6, said positioning apparatus comprising:

a locator receptacle coupled to the seal bore mandrel of the first seal bore conductor;

a latch head coupled to said tubular flow conductor, said latch head being adapted for attachment to a work string and for latching engagement within the locator receptacle.

8. The well completion apparatus as defined in claim 6, said positioning apparatus comprising:

a collet latch assembly coupled to the lower end of said tubular flow conductor, said collet latch being adapted for releasable latching engagement with the second seal bore conductor.

9. The well completion apparatus as defined in claim 1, said well tool comprising a perforating gun assembly suspended from said second tubular flow conductor.

10. The well completion apparatus as defined in claim 9, including a ported sub coupling the perforating gun assembly to said tubular flow conductor.

11. Combination perforating and gravel packing apparatus for completing a well having a well bore intersecting an earth formation, a well casing disposed within the well bore, and first and second packers each having a seal bore mandrel sealed against the well casing above and below the earth formation, said combination perforating and gravel packing apparatus comprising, in combination:

a first tubular flow conductor adapted for suspension within the bore of the well casing;

a first group of annular seals externally mounted on the first tubular flow conductor at longitudinally spaced locations thereon, said annular seals of said first group being adaptable for slidable, sealing engagement against the seal bore mandrel of the first packer;

a second tubular flow conductor coupled in flow communication with said first tubular flow conductor;

a second group of annular seals externally mounted on the second tubular flow conductor at longitudinally spaced locations thereon, each seal in the second group being adapted for sliding, sealing engagement against the seal bore mandrel of the second packer;

a well screen assembly having a production mandrel coupled in flow communication between the first and second tubular flow conductors;

a perforating gun assembly suspended from said second tubular flow conductor;

a flow circulation tool having a circulation mandrel coupled in flow communication with the first tubular flow conductor and the second tubular flow conductor, said circulation tool including a movable closure member for selectively opening and closing a bypass flow passage through said circulation mandrel into the annulus between said well screen assembly and the well casing;

an inner service flow conductor extending in radially spaced relation through the bore of said first tubular flow conductor thereby defining a bypass return flow annulus, said inner flow conductor being coupled in flow communication with the circulation mandrel of said circulation tool; and, a washpipe extending through the bore of said first tubular flow conductor, said washpipe having a first end portion coupled in flow communication with the circulation mandrel of said circulation tool, and having a second end portion extending through the production mandrel of said screen assembly.

12. A perforating and gravel packing apparatus as defined in claim 1, said well screen assembly comprising:

a production screen;

a first seal bore sub suspended from said production screen;

a tell-tale screen suspended from said first seal bore sub;

a second seal bore sub suspended from said tell-tale screen; and, said washpipe being movable from a first position in which it is disposed in sealing engagement against the first seal bore sub and the second seal bore sub, to a second position in which its open end is positioned within the bore of the tell-tale screen.

13. Apparatus for perforating a well having a well bore intersecting an earth formation, a well casing disposed in the well bore, and first and second packers each having a seal bore mandrel sealed against the well casing above and below the earth formation, said perforating apparatus comprising, in combination:

a tubular flow conductor adapted for suspension within the bore of said well casing;

a group of annular seals externally mounted on said tubular flow conductor at longitudinally spaced locations thereon, said annular seals being adaptable for slidable, sealing engagement against the seal bore mandrel of said first packer;

a perforating gun assembly suspended from said tubular flow conductor; and, a latch assembly coupled to the lower end of said tubular flow conductor, said latch assembly being adapted for releasable latching engagement with said second packer.

14. Gravel packing apparatus for completing a well having a well bore intersecting an earth formation, a perforated well casing disposed in the well bore, and first and second packers each having a seal bore mandrel sealed against the well casing above and below the earth formation, said gravel packing apparatus comprising, in combination:

a first tubular flow conductor adapted for suspension within the bore of said well casing;

a first group of annular seals externally mounted on the first tubular flow conductor at longitudinally spaced locations thereon, said annular seals being adapted for slidable, sealing engagement against the seal bore mandrel of the first packer;

a second tubular flow conductor coupled in flow communication with the first tubular flow conductor;

a second group of annular seals externally mounted on the second tubular flow conductor at longitudinally spaced locations thereon, each seal in the second group being adapted for slidable, sealing engagement against the seal bore mandrel of the second packer;

a well screen assembly having a production mandrel coupled in flow communication between the first and second tubular flow conductors;

a flow circulation tool having a circulation mandrel coupled in flow communication with the first tubular flow conductor, said circulation tool including a movable closure member for selectively opening and closing a bypass flow passage through said circulation mandrel into the annulus between the first fluid flow conductor and the perforated well casing;

an inner service flow conductor extending in radially spaced relation through the bore of the first tubular flow conductor thereby defining a bypass return flow annulus, said inner flow conductor being coupled in flow communication with the circulation mandrel of said circulation tool;

a washpipe coupled in flow communication with the circulation mandrel of said flow circulation control tool, said washpipe projecting through said well screen assembly, said washpipe being movable from a first position in which it is disposed in sealing engagement with the well screen assembly for sealing the annulus between said washpipe and the production bore of the well screen assembly, to a second position in which its open end is positioned in communication with the production bore of the well screen assembly; and, said first and second group of annular seals being longitudinally separated with respect to each other by a distance sufficient to permit sealing engagement of one or more annular seals of the first group against the seal bore mandrel of the first packer simultaneously with sealing engagement of one or more annular seals of the second group against the seal bore mandrel of the second packer.

15. The gravel packing apparatus as defined in claim 14, including:

a flapper valve assembly coupled in flow communication with the first tubular flow conductor intermediate the well screen assembly and said flow circulation tool.

16. The gravel packing apparatus as defined in claim 14, including:

a production screen;

a first seal bore sub suspended from said production screen;

a tell-tale screen suspended from said first seal bore sub;

a second seal bore sub suspended from said tell-tale screen; and, said washpipe being movable from a first position in which it disposed in simultaneous sealing engagement against the first seal bore sub and a second seal bore sub, to a second position in which its open end is positioned within the bore of the tell-tale screen.

17. Apparatus for completing a well having a well bore intersecting an earth formation, including first and second seal bore conductors each having a seal bore mandrel disposed at longitudinally spaced locations within the well, said well completion apparatus comprising, in combination:

a tubular flow conductor adapted for longitudinal movement within the well;

a well completion tool coupled to said tubular flow conductor for performing first and second well completion operations;

apparatus coupled to said tubular flow conductor for selectively positioning said well completion tools at multiple operating locations relative to seal bore conductors in response to longitudinal movement of said tubular flow conductor; and, apparatus coupled to said tubular flow conductor for selectively controlling fluid communication through at least one of said seal bore conductors during the performance of said well completion operations, said controlling apparatus including a first group of annular seals externally mounted on said tubular flow conductor at longitudinally spaced locations thereon, said annular seals being adapted for slidable, sealing engagement against the seal bore mandrel of the first seal bore conductor; and, a second group of annular seals externally mounted on said tubular flow conductor at longitudinally spaced locations thereon, each seal in the second group being adapted for slidable, sealing engagement against the seal bore mandrel of the second seal bore conductor.

18. The well completion apparatus as defined in claim 17, said apparatus for selectively controlling fluid communication comprising:

a flow circulation tool having a circulation mandrel coupled in flow communication with said tubular flow conductor, said circulation tool including a movable closure member for selectively opening and closing a bypass flow passage through said circulation mandrel into the annulus between said tubular flow conductor and the well bore;

an inner service flow conductor extending in radially spaced relation through the bore of said tubular flow conductor thereby defining a bypass return flow annulus, said inner flow conductor being coupled in flow communication with the circulation mandrel of said circulation tool.

19. The well completion apparatus as defined in claim 17, said apparatus for selectively controlling fluid communication comprising:

a flow circulation tool having a circulation mandrel coupled in flow communication with said tubular flow conductor, said circulation tool including a movable closure member for selectively opening and closing a bypass flow passage through said circulation mandrel into the annulus between said tubular flow conductor and the well bore;

a first seal bore sub suspended from said well screen;

a tell-tale screen suspended from said first seal bore extension;

a second seal bore sub suspended from said tell-tale screen; and, a washpipe coupled in flow communication with the circulation mandrel of said flow circulation control tool, said washpipe projecting through the first seal bore sub, the tell-tale screen and the second seal bore sub, said washpipe being movable from a first position in which it is disposed in sealing engagement against the first seal bore sub and the second seal bore sub, to a second position in which its open end is positioned in flow communication with the bore of the tell-tale screen.

20. The well completion apparatus as defined in claim 17, said controlling apparatus being adapted for selectively controlling fluid communication between the production bore and the well bore above the first seal bore conductor.

21. The well completion apparatus as defined in claim 17, wherein said well completion tool comprises:

a well screen assembly having a production mandrel coupled in flow communication with said tubular flow conductor; and, a perforating gun assembly suspended from said tubular flow conductor.

* * * * *